US007913656B2

(12) United States Patent
Magnan et al.

(10) Patent No.: US 7,913,656 B2
(45) Date of Patent: Mar. 29, 2011

(54) VARIABLE DISPLACEMENT ENGINE HAVING SELECTIVELY ENGAGEABLE ROCKER ARM WITH POSITIONING DEVICE

(75) Inventors: Michael Bruno Magnan, Dearborn, MI (US); Brian Jon Fregonese, Fond Du Lac, WI (US); Jonathan Patrick Jeffries, Canton, MI (US); Todd Brewer, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 485 days.

(21) Appl. No.: 11/933,373

(22) Filed: Oct. 31, 2007

(65) Prior Publication Data

US 2009/0107428 A1 Apr. 30, 2009

(51) Int. Cl.
*F01L 1/34* (2006.01)

(52) U.S. Cl. ..... 123/90.16; 123/90.39

(58) Field of Classification Search ..... 123/90.16, 123/90.39, 90.43
See application file for complete search history.

(56) References Cited

U.S. PATENT DOCUMENTS 5,107,803 A * 4/1992 Furnivall ..... 123/90.16
5,778,842 A * 7/1998 Schmidt et al. ..... 123/90.39
6,058,895 A * 5/2000 Hermsen ..... 123/90.16

* cited by examiner

*Primary Examiner* — Zelalem Eshete
(74) *Attorney, Agent, or Firm* — Julia Voutyras; Brooks Kushman P.C.

(57) ABSTRACT

Systems and methods for selectively activating and deactivating gas exchange valves in a variable displacement internal combustion engine include a rocker arm having a positioning device that opposes movement of a lash adjustment device while deactivated to position a coupling hole of the rocker arm within a desired coupling range to facilitate coupling of the rocker arm during subsequent activation of an associated engine cylinder.

13 Claims, 6 Drawing Sheets

VARIABLE DISPLACEMENT ENGINE HAVING SELECTIVELY ENGAGEABLE ROCKER ARM WITH POSITIONING DEVICE

BACKGROUND

1. Technical Field

The present disclosure relates to an internal combustion engine having a selectively engageable rocker arm with a device for positioning the rocker arm while disengaged.

2. Background Art

Variable displacement or displacement on demand engines offer the performance of a larger displacement engine with improved fuel economy associated with a smaller displacement engine by selectively activating and deactivating one or more cylinders in response to driver demand and current operating and/or ambient conditions. One strategy used in mechanical valvetrains for selectively deactivating cylinders is to disengage or unlatch at least the intake rocker arms and associated intake valves of selected cylinders. To transition to a higher displacement operating mode, the rocker arms engage or latch to actuate the associated intake valve, which requires alignment of the latching mechanism and the associated rocker arms. Additional mechanical lash or clearance may be added to the system to accommodate manufacturing and assembly tolerances and valvetrain component wear while ensuring proper alignment and latching. Although suitable for some applications, the additional lash added to the system to ensure reliable alignment and latching may result in undesirable noise.

Hydraulic lash adjustment mechanisms are used in various types of mechanical valvetrains to compensate for manufacturing and assembly tolerances and component variations due to temperature changes and wear. In variable displacement engine applications having rocker arms that are selectively coupled and uncoupled to activate and deactivate cylinders, movement of the lash adjuster may result in a corresponding change of position of the latching alignment hole. As such, to ensure proper latching across the range of motion of the lash adjuster under varying operating conditions while also accommodating valvetrain design tolerances, the actuating cam profiles are modified for at least the selectively deactivated cylinders, resulting in design compromises with respect to various factors, such as manufacturing cost and complexity, noise, reliability, and durability, for example.

SUMMARY

Systems and methods for selectively activating and deactivating gas exchange valves in a variable displacement internal combustion engine include a rocker arm having a positioning device that compensates for movement of a lash adjustment device to position the rocker arm within a desired coupling range to facilitate coupling of the rocker arm during activation of an associated engine cylinder.

In one embodiment, a multi-cylinder internal combustion engine having at least one cylinder with at least one mechanically operated intake or exhaust valve selectively deactivated during operation in a reduced displacement mode includes a valvetrain having at least one rocker arm with a first end for engaging the selectively deactivated valve and a second end with a lever pivotable relative to the rocker arm to maintain the lash adjuster position and keep the rocker arm within a desired coupling range while the valve is deactivated. The valvetrain is actuated by a camshaft disposed above the intake/exhaust valves in an overhead cam configuration having a plurality of cams including a concentric cam and an adjacent eccentric cam associated with selectively deactivated cylinders. A stationary fulcrum shaft extends through associated rocker arms and provides pressurized oil for lubrication and operation of the hydraulic lash adjuster. A second rocker arm or eccentric cam follower is mounted for rotation about the fulcrum shaft and includes a first end contacting the eccentric cam, a second end contacting a spring, and a coupling hole disposed between the first and second ends. The first rocker arm lever resiliently contacts the concentric cam when decoupled from the second rocker arm or eccentric cam follower such that the coupling hole of the first rocker arm remains within a desired coupling range for coupling to the second rocker arm by movement of a pin through the first and second coupling holes as the coupling hole of the second rocker arm moves past the coupling hole of the first rocker arm during valve activation.

The present disclosure also includes a method for operating a multi-cylinder internal combustion engine having at least one cylinder with at least one mechanically operated intake and/or exhaust valve selectively deactivated during operating in a reduced displacement mode. The method includes positioning a rocker arm having a hydraulic lash adjuster within a desired coupling range by opposing movement of the hydraulic lash adjuster while the intake and/or exhaust valve is deactivated and the rocker arm is uncoupled from movement with an eccentric cam.

Embodiments of a variable displacement engine and associated rocker arm according to the present disclosure provide various advantages. For example, the spring-loaded positioning device of one embodiment maintains the rocker arm in a desired latching position for coupling with an associated rocker arm or eccentric cam follower during activation of the valve facilitating use of the same cam profiles for cylinders that can be deactivated and those without deactivation capability. Eliminating design compromises associated with ensuring reliable coupling by modification of the cam profiles provides more optimized profiles to improve durability and combustion performance while reducing noise. A resilient follower lever for a rocker arm according to the present disclosure reduces the contact loads reducing wear and improving durability.

The above advantages and other advantages and features of the present disclosure will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present disclosure as illustrated and described with reference to any one of the Figures may be combined with features illustrated in one or more other Figures to produce embodiments of the present disclosure that are not explicitly illustrated or described. The combinations of features illustrated provide representative embodiments for typical applications. However, various combinations and modifications of the features consistent with the teachings of the present disclosure may be desired for particular applications or implementations.

FIGS. 1-9 illustrate operation of an internal combustion engine and valvetrain according to representative embodiments of the present disclosure. Multiple cylinder internal combustion engine 10 is generally of conventional design with the exception of various valvetrain components as described herein. As such, various conventional features associated with the engine and valvetrain may not be explicitly illustrated or described. Those of ordinary skill in the art will recognize that the present invention may be used in various types and configurations of engines including but not limited to compression ignition and spark ignition engines arranged in a "V" configuration or an in-line configuration, for example. The representative embodiments illustrated include a two-valve-per-cylinder overhead cam engine. However, a valvetrain with rocker arms according to the present disclosure may be used in any applications having at least one mechanically actuated and selectively deactivated gas exchange valve associated with at least one cylinder for operating the engine in a reduced or variable displacement mode.

A "cam follower" as used herein refers in the broadest sense to any device that contacts or follows a cam profile on a rotating camshaft to provide a desired position or motion, which may include a reciprocating motion for valve actuation when following an eccentric cam profile, or a substantially stationary position when following a cam profile that is concentric with the camshaft as described in greater detail herein. As such, depending upon the particular valvetrain configuration, a cam follower may include a roller, finger, arm, or pad, for example, in contact with the cam profile. The cam follower may pivot about various types of fulcrums and positions of pivot points including a ball/socket configuration and a roller shaft, for example. Similarly, depending upon the particular type of engine and valvetrain, a cam follower may also refer to a lifter, tappet, roller follower, or finger follower, for example. Those of ordinary skill in the art will recognize various other engine and/or valvetrain configurations in which a cam follower having a positioning device that reacts to movement of a hydraulic lash adjuster according to the present disclosure may be beneficial.

Figure 1:
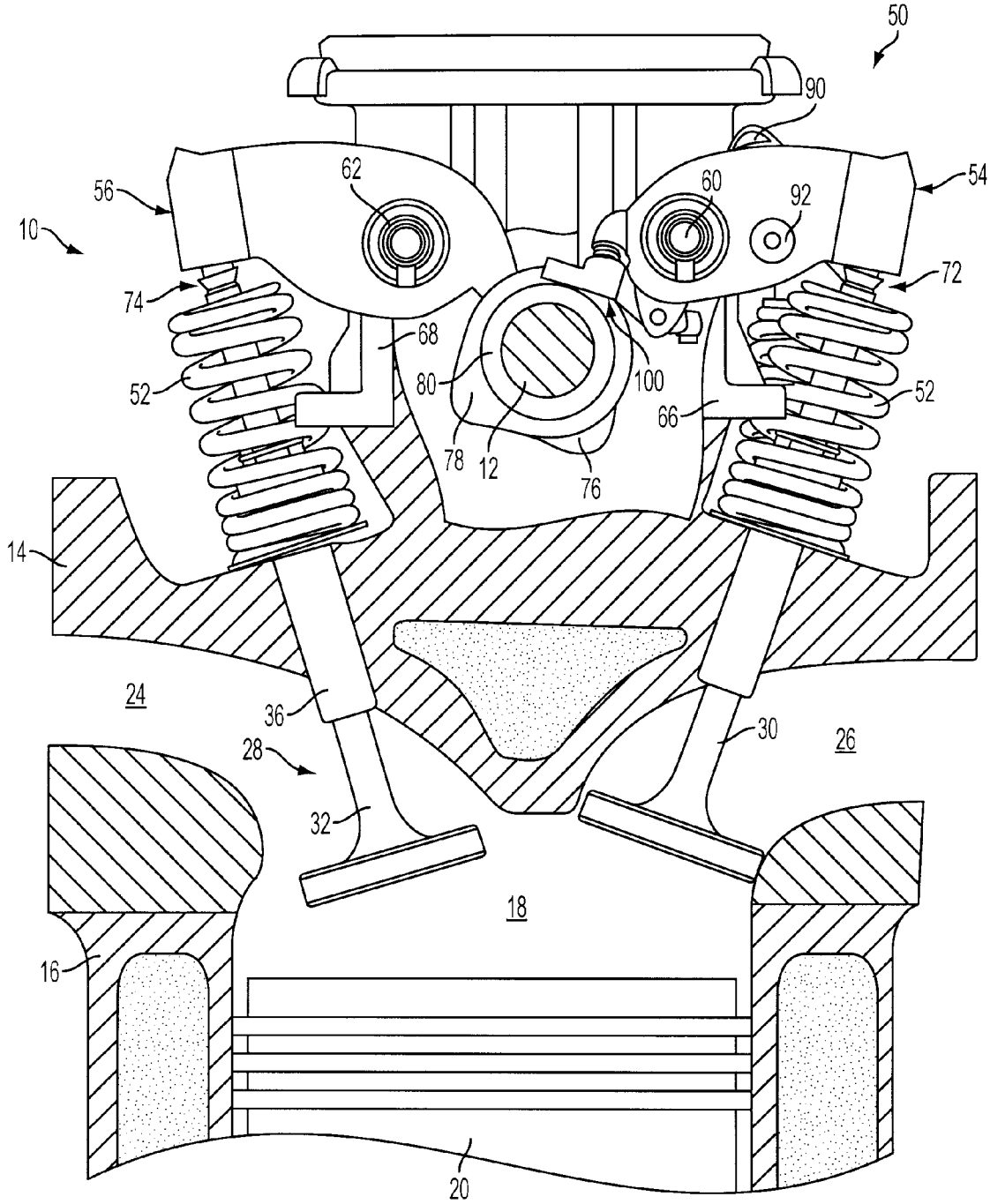
FIG. 1 is a partial cross-sectional view of an internal combustion engine having a valvetrain selectively operable in a reduced displacement mode according to one embodiment of the present disclosure.

As shown in the partial cut-away/cross-section of a representative application in FIG. 1, multiple cylinder internal combustion engine 10 includes at least one camshaft 12 disposed within a cylinder head 14 secured to an engine block 16, and may be referred to as an overhead cam (OHC) engine. Each cylinder 18 includes a reciprocating piston 20 coupled by a connecting rod to a crankshaft (not shown) as well known in the art. Cylinder head 14 provides conventional intake 22 and exhaust 24 ports having associated gas exchange valves 28, which include at least one intake valve 30 and at least one exhaust valve 32. Cylinder head 14 includes conventional hardware such as valve guides or bushings 36 in addition to valve seats and various other hardware (not shown) associated with operation of gas exchange valves 28.

Engine 10 includes a mechanically operated valvetrain 50 to actuate gas exchange valves 28 to control intake of air and/or fuel (for port injected engines) into cylinder 18 through intake port 22 and exhaust of combustion gases through exhaust port 24. Valvetrain 50 includes valves 28, valve springs 52, an intake rocker arm assembly 54 and an exhaust rocker arm assembly 56 mounted for pivoting or limited rotation about corresponding stationary roller shafts or fulcrum shafts 60, 62. Roller shafts 60, 62 extend generally parallel to camshaft 12 and are secured by support towers 66, 68 disposed within cylinder head 14. Roller shafts 60, 62 may include one or more channels for providing pressurized hydraulic fluid or lubricating oil to rocker arms 54, 56 and operating corresponding hydraulic lash adjusters 72, 74 contained therein (best illustrated in FIG. 2). Camshaft 12 includes one or more eccentric cams 76, 78 having a desired profile or lobe to actuate valves 28. In addition, camshaft 12 may include one or more concentric cams 80 having a profile that is substantially concentric with the central shaft of camshaft 12 to position corresponding rocker arms 54 while deactivated for subsequent coupling or engagement during activation as described herein.

As shown in FIG. 1, engine 10 includes at least one gas exchange valve 28 associated with at least one selectively deactivated cylinder 18 to provide operation in a reduced or variable displacement mode. In the embodiment illustrated, intake valve 30 may be selectively deactivated while operating in a reduced displacement mode as described in greater detail herein. While a two valve-per-cylinder engine having one of the valves selectively deactivated to provide reduced displacement is shown for ease of illustration and description, the present disclosure includes applications and embodiments not specifically illustrated with multiple valves-per-cylinder selectively activated or deactivated in response to a command signal from an engine controller. Similarly, the present disclosure includes embodiments having exhaust valves selectively deactivated and embodiments where intake and exhaust valves are selectively deactivated during operation in one or more reduced displacement operating modes. Representative applications include engines having multiple cylinders selectively activated or deactivated as a group by disabling associated intake and/or exhaust valves. Likewise, embodiments of the present disclosure may be used in applications having multiple reduced displacement modes with individually controllable valves/cylinders or multiple groups of controllable valves/cylinders corresponding to different displacements, for example.

In the representative embodiment of FIG. 1, intake valve rocker arm 54 is selectively coupled to an adjacent eccentric cam follower or rocker arm 90 by an associated pin 92 extending through rocker arm 54 and rocker arm 90 when cylinder 18 is activated. The position of pin 92 is controlled by a hydraulic mechanism (not show) in response to a command from the engine/vehicle controller to selectively couple and uncouple rocker arm 54 to rocker arm 90 (best shown in FIGS. 2-4) for activation and deactivation, respectively, of cylinder 18. Rocker arm 54 includes a positioning device 100 that positions rocker arm 54 within a desired coupling range by opposing movement of hydraulic lash adjuster 72 while deactivated to facilitate coupling of rocker arm 54 to rocker arm 90 for activation of intake valve 30. While deactivated or uncoupled, positioning device 100 of rocker arm 54 contacts concentric cam 80 of camshaft 12 and maintains position of rocker arm 54 within a desired coupling range for subsequent coupling via pin 92. The external profile of cam 80 is substantially concentric with the central shaft of camshaft 12 such that rotation of camshaft 12 does not result in any reciprocating motion of rocker arm 54 and the force of spring 52 maintains valve 30 in a closed position (deactivated). During activation, pin 92 couples rocker arm 54 to eccentric cam follower 90, which is in contact with a corresponding eccentric cam 76 while cam 76 rotates through the base circle (concentric) portion of its profile. As the associated eccentric cam 76 continues to rotate, cam follower 90, and rocker arm 54, which is now coupled to cam follower 90 via pin 92, move in response and open valve 30.

Rocker arm 54 includes a hydraulic lash adjuster 72 of conventional design (best shown in FIG. 2) that operates to remove lash or space between components of the valvetrain as the components vary during operation due to temperature changes, wear, etc. Lash adjuster 72 uses pressurized hydraulic fluid, such as lubricating oil supplied by the engine oil pump through roller shaft 60 and rocker arm 54, to provide a fluid coupling that can extend/retract relative to rocker arm 54 to remove lash from the system. According to the present disclosure, positioning device 100 opposes motion or movement of lash adjuster 72 while rocker arm 54 is disengaged or deactivated to maintain the coupling hole of rocker arm 54 in a desired position or within a desired coupling range to facilitate engagement of pin 92 during subsequent valve activation.

With continuing reference to FIG. 1, although exhaust valve 32 is associated with a selectively deactivated or variable displacement cylinder 18, exhaust valve 32 may be actuated by a rocker arm 56 of conventional design having a conventional hydraulic lash adjuster 74. As such, exhaust valve 32 is actuated by rocker arm 56, which remains in contact with an associated eccentric cam 78 on camshaft 12 whether cylinder 18 and intake valve 30 is activated or deactivated. In the embodiment illustrated in FIGS. 7-8, both the intake valve and exhaust valve associated with a particular cylinder are selectively deactivated during operation in a reduced displacement mode.

Figure 2:
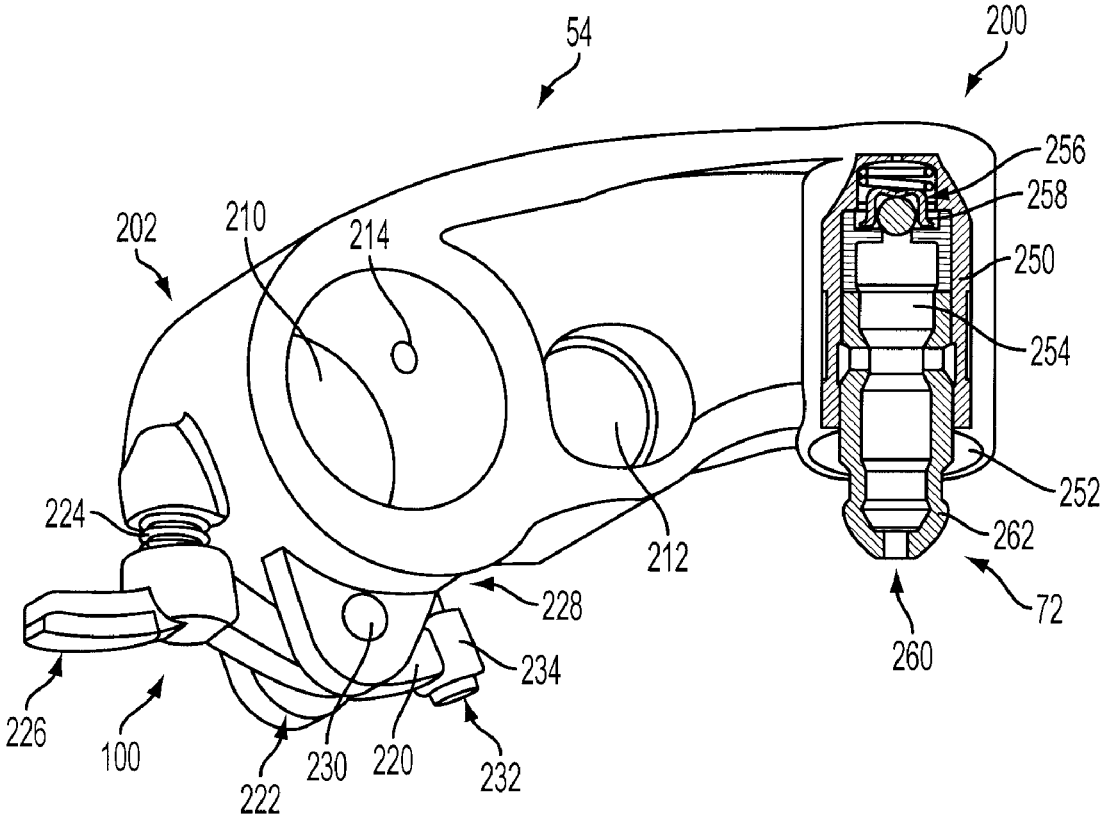
FIG. 2 illustrates a rocker arm having a positioning device and hydraulic lash adjuster according to one embodiment of the present invention.

FIG. 2 illustrates one embodiment of a rocker arm having a positioning device according to the present disclosure. Rocker arm 54 includes a hydraulic lash adjuster 72 in a first end 200 that engages the selectively deactivated intake or exhaust valve. Positioning device 100 is disposed on a second end 202 of rocker arm 54. Rocker arm 54 includes a through hole 210 for mounting on a stationary roller shaft 60 (FIG. 1) and a coupling hole 212 adapted to receive a coupling pin 92 (FIG. 1) to selectively couple rocker arm 54 to an adjacent rocker arm 90 (FIG. 1) during valve activation. An oil hole 214 extends from hole 210 above coupling hole 212 through end 200 to provide pressurized lubricating oil for valvetrain lubrication and for operation of hydraulic lash adjuster 72.

Positioning device 100 includes a lever or lever arm 220 pivotally secured to rocker arm supports 222 by an associated pin 230 extending therethrough, which functions as a fulcrum for lever arm 220. A spring 224 is disposed between lever arm 220 and rocker arm 54 to resiliently bias a wear-resistant cam follower surface or pad 226 relative to rocker arm 54. Other applications and implementations may use different types of resiliently biased cam followers. For example, a resiliently biased cam follower may be implemented by a roller follower mounted on a spring-biased axle, for example. Similarly, the cam follower may be implemented by an arm that extends from only one side of the pivot pin 230, similar to the embodiment illustrated and described with reference to FIGS. 5-9, or by an arm that extends from both sides of the fulcrum and that has a spring 224 or other biasing element, such as a pneumatic or hydraulic cell or cylinder on either or both sides of the fulcrum.

In the representative embodiment illustrated in FIG. 2, lever arm 220 extends on opposite sides of fulcrum or pivot pin 230 to provide a biasing spring 224 on one side and a fixed or adjustable spacer or positive stop 238 on an opposite side of the fulcrum relative to spring 224. Spacer or positive stop 228 may be associated with lever arm 220 and/or rocker arm 54, i.e. stop 228 may extend only from rocker arm 54, only from lever 220, or from both lever arm 220 and rocker arm 54, and may be implemented by a fixed pad or an adjustable device. Where an adjustable device is provided, spacer/stop 228 may be used to provide a fine adjustment of the rocker arm position during assembly. Alternatively, selection of a spring 224 among springs having slightly different lengths could be used to adjust the resting or deactivated position of rocker arm 54 during assembly. In one representative embodiment, spacer/stop 228 is implemented by a threaded stud 232 movable within a corresponding threaded hole within end 234 of lever arm 220 to increase or decrease the minimum space between rocker arm 54 and lever arm end 234.

Hydraulic lash adjuster 72 is generally of conventional design and fits within a bore 252 in end 200 of rocker arm 54. Lash adjuster 72 includes a sleeve 250 having a closed end and an open end with a one or two-piece plunger 262 disposed therein. Plunger 262 defines a low-pressure chamber 254 therein, and a high-pressure chamber 256 between the closed end of sleeve 250 and the plunger 262. Low-pressure chamber 254 and high-pressure chamber 256 are separated by a spring biased check-valve 258, which allows hydraulic fluid to flow from low-pressure chamber 254 into high-pressure chamber 256. Plunger 262 extends from, or retracts into, sleeve 250 based on the volume of hydraulic fluid within high pressure chamber 256 to provide an adjustable length fluid coupling between rocker arm 54 and an associated valve. Hydraulic fluid escapes from high-pressure chamber 256 through a rate-controlled leak-down path formed by clearance between sleeve 250 and plunger 262. Plunger 262 may include a convex end with a lubricating hole 260 to provide lubricating oil to the associated intake/exhaust valve stem.

In operation, lash adjuster 72 essentially eliminates any lash or clearance between the valve train components under varying operating and ambient conditions to provide consistent and reliable valve actuations including repeatable valve opening and closing times and peak lift values. As the length of an associated valve stem varies due to temperature variation or wear, hydraulic fluid from a pressurized supply is fed through stationary shaft 60 into channel 214 of rocker arm 54. The pressurized hydraulic fluid, which is preferably engine lubricating oil, flows into hole 252 and through sleeve 250 into low-pressure chamber 254 of plunger 252. A small amount of hydraulic fluid passes through check valves 258 into high-pressure chamber 256 moving plungers 262 away from closed end of sleeve 250 to remove any lash or clearance. As plunger 252 extends, spring 224 of positioning device 100 acts on rocker arm 54 relative to the associated concentric cam so that lash adjuster 72 is maintained at approximately the middle of its range of travel and coupling hole 212 is maintained within a desired coupling range for subsequent alignment with the coupling hole of an adjacent cam follower and engagement of the coupling pin so that rocker arm 54 can be actuated by the eccentric cam associated with the adjacent rocker arm.

In a similar fashion, if valve stem increases in length due to thermal expansion, hydraulic fluid slowly escapes from high-pressure chambers 256 between plungers 262 and sleeves 250 to retract plunger 262 with positioning device 100 reacting in response to the lash adjuster movement to maintain coupling hole 212 within a desired coupling range.

Figure 3:
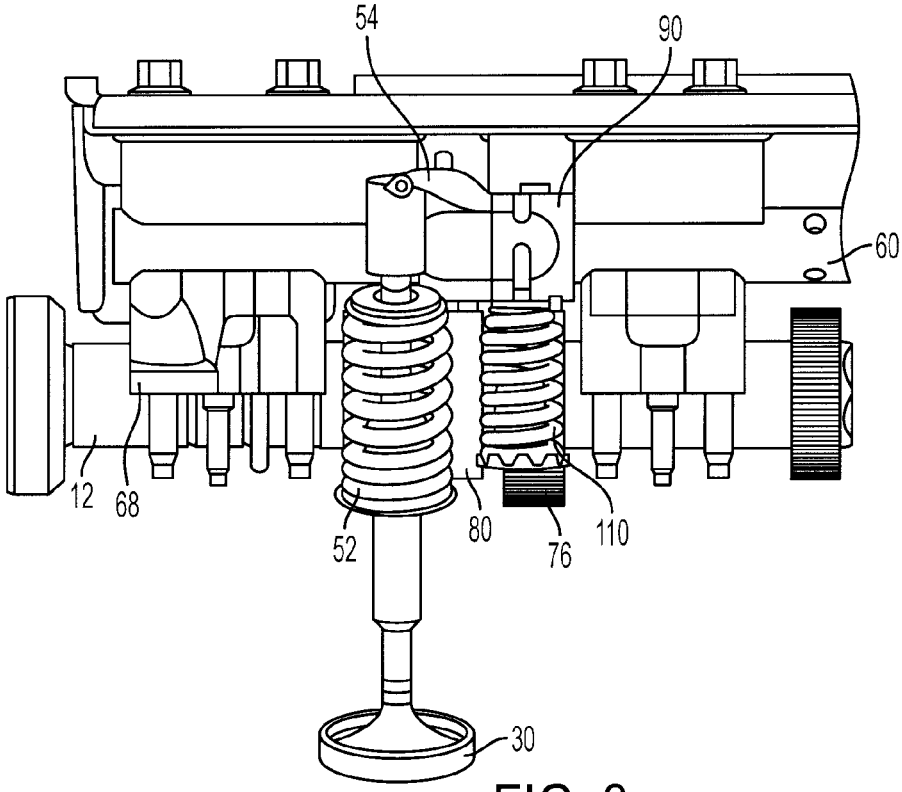
FIG. 3 is a side view of a valvetrain having an intake valve selectively coupled to an eccentric cam follower to activate a corresponding cylinder of an internal combustion engine according to one embodiment of the present disclosure.
Figure 4:
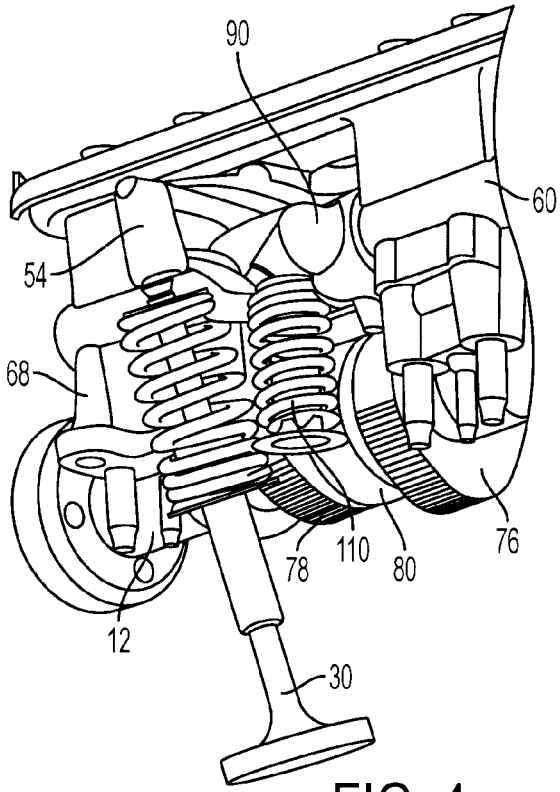
FIG. 4 is a perspective view of a valvetrain having a rocker arm with a positioning device according to one embodiment of the present disclosure.

FIG. 3 is a side view and FIG. 4 is a perspective view of a valvetrain illustrating operation of a selectively deactivated gas exchange valve using a rocker arm having a positioning device according to one embodiment of the present disclosure. FIGS. 3 and 4 illustrate a rocker arm 54 and adjacent rocker arm 90 mounted on roller shaft 60 and having corresponding coupling holes aligned. Rocker arm 90 has one end following the profile of an eccentric cam lobe 76 on camshaft 12 and the opposite end in contact with spring 110, which reacts against the cylinder head (not shown) to keep rocker arm 90 in constant contact with cam 76. Rocker arm 54 has one end with positioning device 100 (FIGS. 1-2) following the profile of concentric cam 80 on camshaft 12 and the opposite end in contact with the valve stem via the hydraulic lash adjuster as previously described. Valve spring 52, which is also secured to the valve stem, reacts against the cylinder head (not shown) to keep valve 30 closed and to keep rocker arm 54 in constant contact with cam 80 while valve 30 is deactivated.

During operation with valve 30 deactivated, as camshaft 12 rotates, eccentric cam 76 produces reciprocating motion of rocker arm 90 against spring 110. However, rocker arm 54 remains substantially stationary due to the opposing force of valve spring 52 and that rocker arm 54 contacts concentric cam 80 with positioning device 100 (FIGS. 1-2), which opposes movement of hydraulic lash adjuster 72 (FIGS. 1-2) while deactivated. As such, the coupling hole of rocker arm 54 remains in a substantially stationary position within a desired coupling range as the coupling hole of rocker arm 90 moves across in a somewhat arcuate reciprocating fashion. In response to an activation signal from the engine/vehicle controller, an associated hydraulic activation device (not shown) extends a coupling pin through the corresponding coupling holes of rocker arm 54 and rocker arm 90 when they are aligned (as illustrated in FIGS. 3-4) so that rocker arm 54 moves together with rocker arm 90 and moves in response to eccentric cam 76 to open valve 30 against the spring force of springs 52 and 110.

Additional embodiments of engine valvetrains having rocker arms with a positioning device that opposes hydraulic lash adjuster motion according to the present disclosure are illustrated in FIGS. 5-9. Primed reference numerals refer to elements that generally have a similar structure and/or function as previously described elements having corresponding unprimed reference numerals unless otherwise indicated.

Figure 5:
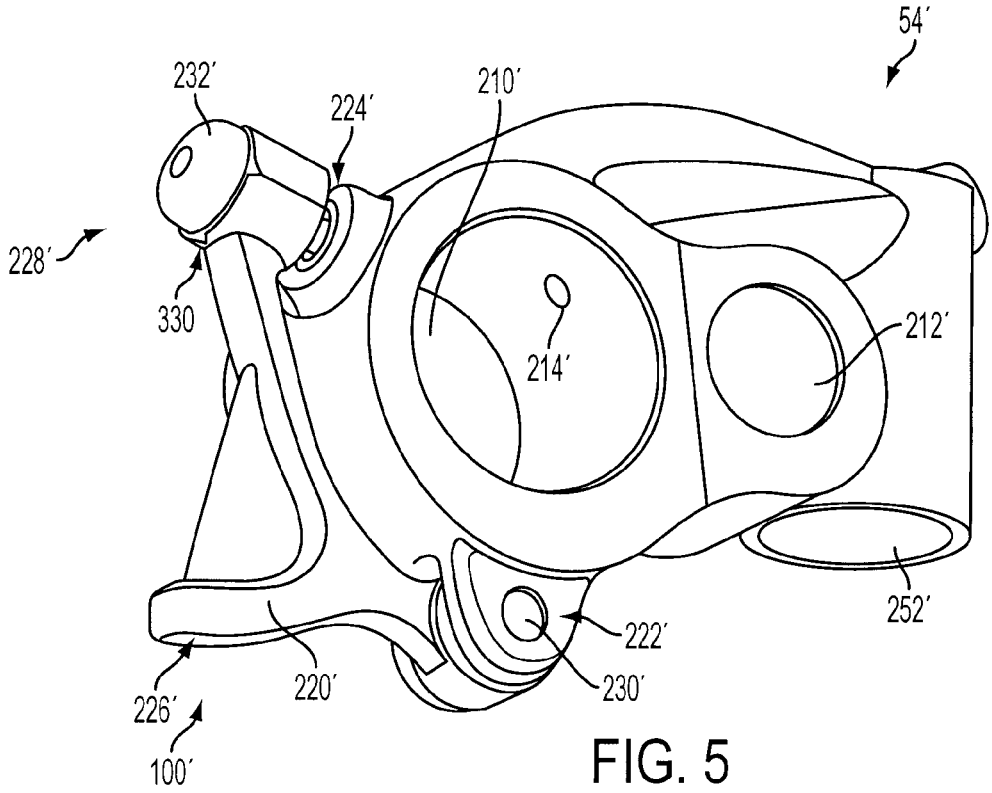
FIG. 5 is a perspective view of an alternative embodiment of a rocker arm having a positioning device according to the present disclosure.
Figure 6:
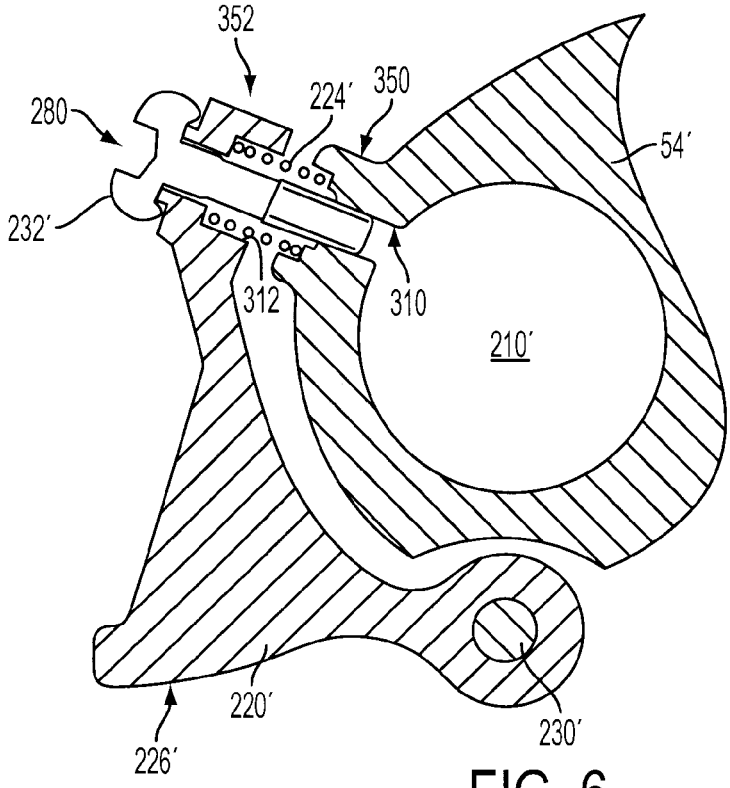
FIG. 6 is a partial cross-sectional view of the embodiment of FIG. 5 illustrating an adjustable stop for the positioning device.
Figure 7:
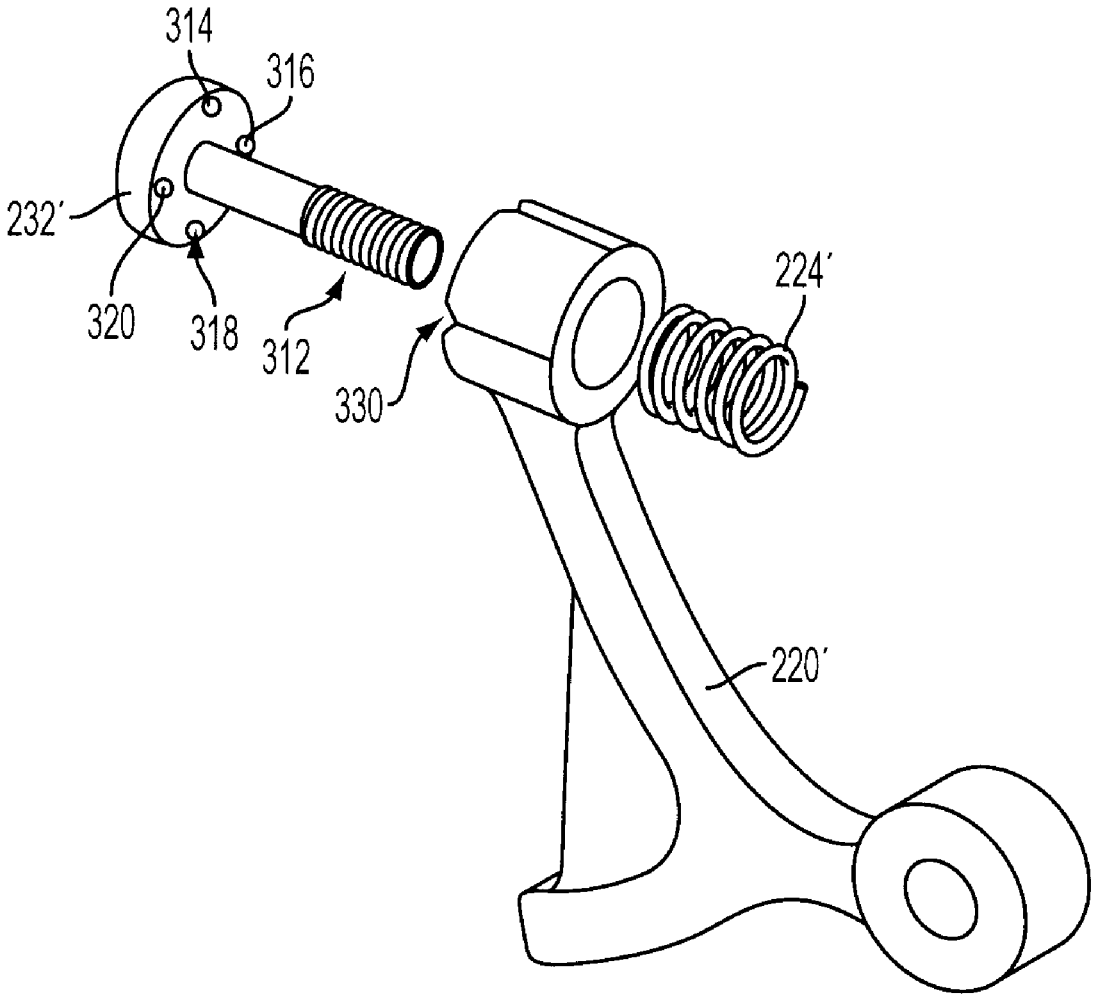
FIG. 7 is a perspective view of one embodiment for an adjustable positive stop for a positioning device according to the present disclosure.

Another embodiment of a rocker arm 54' is shown in the perspective views of FIGS. 5 and 7, and the partial cross-sectional view of FIG. 6. Rocker arm 54' includes a positioning device 100' to provide resilient contact with a corresponding camshaft as previously described. In this embodiment, positioning device 100' includes a contact arm 220' pivotably secured to rocker arm 54' by a pin 230' extending through corresponding supports 222' of rocker arm 54'. Contact arm 220' includes a wear-resistant contact surface 226' and extends from the pivot point at pin 230' to an adjustable positive stop 228'. As illustrated and described in FIGS. 6-7, adjustable positive stop 228' can be adjusted during valvetrain assembly to increase or decrease the maximum travel of spring 224', which determines the deactivated or resting position of rocker arm 54' relative to an associated concentric cam on the camshaft. Adjustable positive stop 228' includes a threaded bolt 232' that engages a corresponding threaded portion of a counterbored hole 310 in rocker arm 54'. Contact arm 220' includes a complementary (unthreaded) counterbored hole 312 to form a pocket for receiving spring 224'.

As best shown in FIGS. 5 and 7, the adjustable positive stop 228' of contact arm 220' may include a plurality of notches, grooves, or similar features 330 in the upper surface of boss 352 that cooperate with protrusions 314-318 on the underside of adjustment bolt 232' to provide a locking feature. In the representative embodiment illustrated, boss 352 includes four equally spaced V-shaped notches and bolt 232' includes four equally spaced hemispherical protrusions. To adjust the position of positive stop 228', contact arm 220' is moved against the force of spring 224' while turning bolt 232' to increase or decrease the maximum travel of spring 224. When contact arm 220' is released, the force of spring 224' acting on the threads of bolt 232' cooperates with the complementary locking features of bolt 232' and boss 352 so that positive stop 228' maintains its position during operation of the valvetrain. Those of ordinary skill in the art will recognize that the quantity, geometry, positioning, spacing, etc. of complementary locking features may vary depending upon the particular application and implementation. For example, bolt 232' may include two protrusions with boss 352 having six or eight grooves depending on the desired number of locking positions, the thread pitch of the fastener, etc. Similarly, boss 352 may include protrusions that cooperate with dimples in fastener 232', etc.

Figure 8:
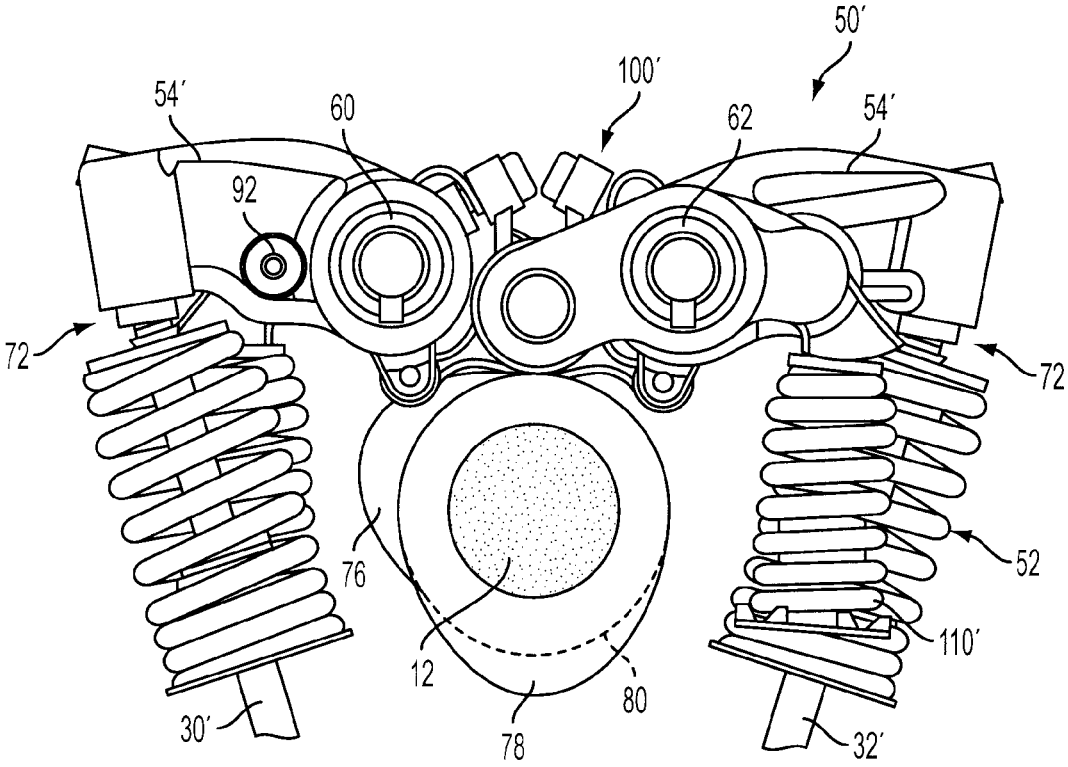
FIG. 8 is a front view of an alternative embodiment for an engine having a valvetrain using rocker arms as shown in the embodiment of FIG. 5 for selectively deactivating an intake and an exhaust valve.
Figure 9:
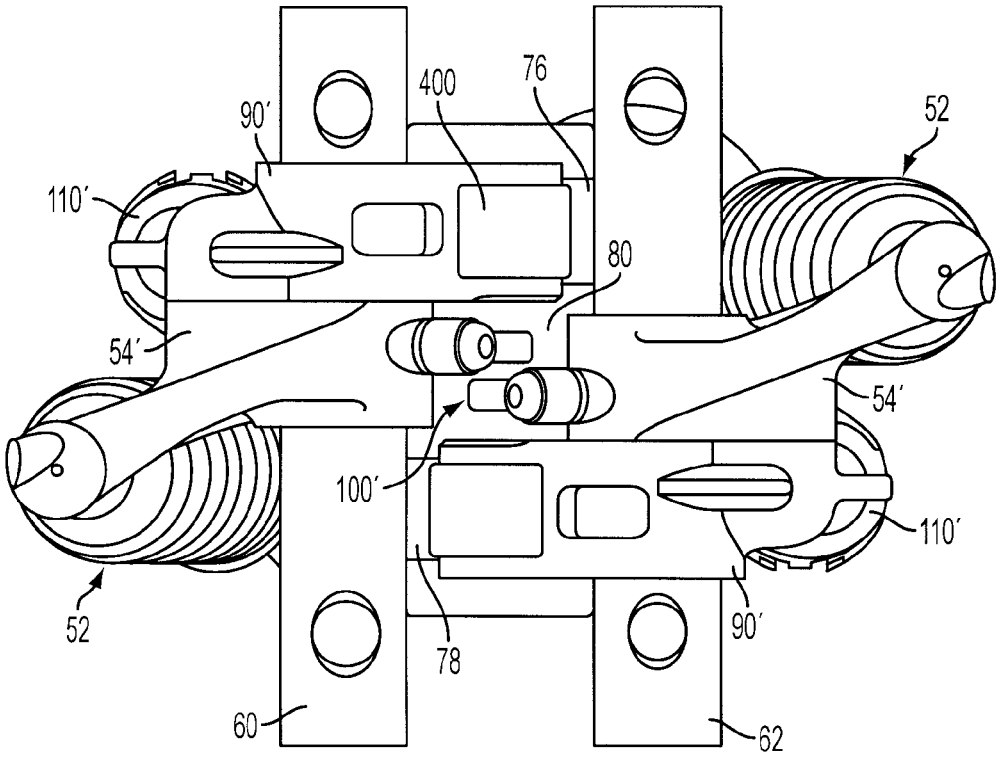
FIG. 9 is a top view of the embodiment of an engine valvetrain as illustrated in FIG. 8.

Another embodiment of an internal combustion valvetrain having mechanically actuated selectively deactivated gas exchange valves is illustrated in the front view of FIG. 8 and the top view of FIG. 9. In this representative embodiment, both intake valve 30' and exhaust valve 32' are selectively deactivated for operation in a reduced displacement mode. Valvetrain 50' incorporates rocker arms 54' that each include a positioning device 100' as illustrated and described with reference to FIGS. 5-7. As shown in the top view of FIG. 9, the positioning devices 100' for both rocker arms 54' contact a common concentric cam 80 on camshaft 12 when deactivated. Cam followers 90' each include a roller 400 in contact with an associated eccentric cam 76 for operation of intake valve 30', and eccentric cam 78 for operation of exhaust valve 32' when coupled to corresponding rocker arms 54'.

As illustrated in FIGS. 1-9, a method for operating engine 10 and valvetrain 50 to selectively activate and deactivate a gas exchange valve 28 according to the present disclosure includes positioning a rocker arm 54 having a hydraulic lash adjuster 72 within a desired coupling range by opposing movement of the hydraulic lash adjuster 72 while the gas exchange valve 28 is deactivated and the rocker arm 54 is uncoupled from movement with an eccentric cam 76 to facilitate coupling of the rocker arm 54 for movement with an eccentric cam 76 during activation of the gas exchange valve 28. In one embodiment, a method of the present disclosure includes positioning the rocker arm 54 by resiliently biasing a cam follower 100 pivotally secured to the rocker arm 54 relative to a concentric cam 80 associated with the gas exchange valve 28 such that movement of the hydraulic lash adjuster 72 results in movement of the rocker arm 54. In one representative embodiment, rocker arm 54 is positioned within a desired coupling range by contacting a cam 80 with a spring-biased lever 220 secured to one end 202 of the rocker arm 54. Embodiments may include limiting movement of the spring-biased lever 220 with an adjustable stop 232 disposed on at least one of the lever 220 and the rocker arm 54. In one embodiment, positioning the rocker arm 54 within a desired coupling range comprises automatically adjusting the position of rocker arm 54 in response to movement of the hydraulic lash adjuster 72 such that a coupling hole 212 disposed between a fulcrum and the hydraulic lash adjuster 72 is positioned for alignment with a coupling pin 92 extending through an adjacent rocker arm 90 during activation of the intake and/or exhaust valve 30.

As such, embodiments of an internal combustion engine and associated valvetrain having a rocker arm with a positioning device according to the present disclosure provide various advantages. The spring-loaded positioning device maintains the rocker arm in a desired latching position for coupling with an associated rocker arm or eccentric cam follower during activation of the valve so that the same eccentric cam profiles may be used for cylinders that can be deactivated and those without deactivation capability. Eliminating design compromises by replacing modification of the cam profiles with a compensating positioning device according to the present disclosure provides more optimized cam profiles to improve durability and combustion performance while reducing noise.

While the best mode has been described in detail, those familiar with the art will recognize various alternative designs and embodiments within the scope of the following claims. Various embodiments may have been described as providing advantages or being preferred over other embodiments or prior art implementations in regard to one or more desired characteristics. However, as one skilled in the art is aware, one or more characteristics may be compromised to achieve desired system attributes, which depend on the specific application. These attributes include, but are not limited to: cost, strength, durability, life cycle cost, marketability, appearance, packaging, size, serviceability, weight, manufacturability, ease of assembly, etc. Any embodiments described herein as less desirable relative to another embodiment or the prior art with respect to one or more characteristics are not outside the scope of the following claims.

What is claimed:

1. A system for a variable displacement internal combustion engine comprising:

a plurality of selectively activated gas exchange valves actuated by a rocker arm with a hydraulic lash adjuster only when activated;

a positioning device associated with the rocker arm that positions the rocker arm within a desired coupling range by opposing movement of the hydraulic lash adjuster while deactivated to facilitate coupling of the rocker arm and activation of the gas exchange valve, wherein the rocker arm includes a coupling hole for receiving a pin to couple the rocker arm for movement with an eccentric cam when activated and wherein the positioning device biases the rocker arm relative to a concentric cam when deactivated such that position of the coupling hole is substantially maintained independent of the hydraulic lash adjuster position.

2. The system of claim 1 wherein the positioning device comprises:

a lever arm pivotally secured to the rocker arm at a fulcrum;

a spring disposed between the lever arm and the rocker arm on a first side of the fulcrum;

a spacer disposed between the lever arm and the rocker arm.

3. The system of claim 2 wherein the spacer is movable to increase or decrease the maximum travel of the spring.

4. The system of claim 3 wherein the spacer comprises a threaded spacer movable within a corresponding threaded hole in at least one of the lever arm and the rocker arm to increase or decrease the maximum travel of the spring.

5. An engine having at least one valve selectively deactivated during operation in a reduced displacement mode, the engine comprising:

at least one rocker arm having a first end for engaging the selectively deactivated valve and a second end with a contact arm pivotable relative to the rocker arm and in contact with a concentric camshaft lobe to position the rocker arm within a desired coupling range while the valve is deactivated, and a coupling hole disposed between the first and second ends;

a camshaft disposed above the intake/exhaust valves and having a plurality of cams including a concentric cam and an adjacent eccentric cam associated a selectively deactivated cylinder;

at least one stationary fulcrum shaft extending through associated rocker arms;

a cam follower mounted for rotation about the fulcrum shaft and having a first end contacting the eccentric cam, a second end contacting a spring, and a coupling hole disposed between the first and second ends; and wherein the rocker arm resiliently contacts the concentric cam when decoupled from the cam follower such that the coupling hole of the rocker arm remains within a desired coupling range for coupling to the cam follower as the coupling hole of the cam follower moves past the coupling hole of the rocker arm during valve activation.

6. The engine of claim 5 wherein the rocker arm includes a hydraulic lash adjuster disposed within a bore of the first end and wherein the contact arm opposes movement of the hydraulic lash adjuster while the valve is deactivated.

7. The engine of claim 5 wherein the rocker arm further comprises:

a spring disposed between the contact arm and the rocker arm to maintain position of the rocker arm within the desired coupling range while the valve is deactivated.

8. The engine of claim 7 wherein the rocker arm further comprises:

an adjustment mechanism positioned on at least one of the rocker arm and the contact arm to provide an adjustable maximum travel for the spring.

9. The engine of claim 5 wherein the rocker arm further comprises:

a spring-biased contact arm pivotably secured to the rocker arm and having a contact surface in contact with the concentric cam.

10. The engine of claim 9 wherein the valvetrain further comprises a spring disposed between the rocker arm and the contact arm.

11. The engine of claim 5 wherein the rocker arm resiliently contacts the concentric cam with a spring-biased contact arm having an adjustable positive stop, the adjustable positive stop comprising:

a first plurality of locking features circumferentially spaced about an upper surface of a boss on the contact arm;

a second plurality of locking features circumferentially spaced about a lower surface of a threaded adjustment stud that engages a corresponding threaded hole in the rocker arm, wherein the first and second plurality of locking features have complementary geometries that engage and resist rotation of the threaded adjustment stud within the threaded hole during engine operation.

12. The engine of claim 5 wherein the contact arm is pivotally secured to the rocker arm by a pin extending through the contact arm and corresponding supports of the rocker arm.

13. A method comprising:

positioning a rocker arm having a hydraulic lash adjuster within a desired coupling range by opposing movement of the lash adjuster while an intake and/or exhaust valve is deactivated by automatically adjusting rocker arm position so a coupling hole disposed between a fulcrum and the hydraulic lash adjuster is positioned for alignment with a coupling pin extending through an adjacent rocker arm during activation of the intake and/or exhaust valve.

* * * * *